US005838102A

United States Patent [19]

Bijloo

[11] Patent Number: 5,838,102

[45] Date of Patent: Nov. 17, 1998

[54] METHOD OF FIXING A STACK OF PLATES; A STACK OF PLATES; A THINTYPE DISPLAY DEVICE PROVIDED WITH A STACK OF PLATES

[75] Inventor: Jan A. Bijloo, Eindhoven, Netherlands

[73] Assignee: U.S. Philips Corporation, New York, N.Y.

[21] Appl. No.: 832,639

[22] Filed: Apr. 4, 1997

[30] Foreign Application Priority Data

May 10, 1996 [EP] European Pat. Off. ..... 962012803

[51] Int. Cl.[6] ..... H01T 9/18

[52] U.S. Cl. ..... 313/495; 313/422; 445/23

[58] Field of Search ..... 313/495, 496, 313/497, 422, 238, 105 CM, 103 CM; 445/22, 23, 24, 44

[56] References Cited

U.S. PATENT DOCUMENTS 5,313,136 5/1994 Van Gorkom et al. ..... 313/422

5,581,148 12/1996 Nakatani et al. ..... 313/238

*Primary Examiner*—Nimeshkumar Patel

*Attorney, Agent, or Firm*—Norman N. Spain

[57] ABSTRACT

The method of successively positioning and fixing n plates forming a stack (21–26) relative to a mounting face (20), includes the positioning and alignment, if necessary, of n plates (21∝26), each plate (21–26) being retained, after it has been positioned relative to the mounting face (20) or relative to plates (21–25) which have already been positioned, by means of a vacuum in a vacuum pipe in the plates (21–25) already positioned. When all plates (21–26) are positioned and retained by a vacuum system connected to vacuum apertures (201–206) in the mounting face (20), successive plates (21–26) can be fixed relative to each other so as to form the stack of n plates (21–26). The vacuum pipes form ducts in the plates (21–25), at least one duct comprising i (i=1,2,3, . . . , n−1) corresponding apertures (215; 214, 224; 213, 223, 233; 212, 222, 232, 242; 211, 221, 231, 241, 251) in i plates (21–25) and being closed by a plate i+1 (21–26). Such stacks are used in thin-type display devices.

12 Claims, 4 Drawing Sheets

METHOD OF FIXING A STACK OF PLATES; A STACK OF PLATES; A THINTYPE DISPLAY DEVICE PROVIDED WITH A STACK OF PLATES

BACKGROUND OF THE INVENTION

The invention relates to a method of successively positioning and fixing n plates so as to form a stack.

The invention further relates to a stack of n plates.

The invention also relates to a thin-type display device comprising a transparent front wall, which is provided with a display screen having a pattern of pixels, and a rear wall which extends parallel to said front wall, which display device comprises at least an electron source and means for guiding electrons to the display screen, which means include a branched network of electron-propagation means, said network comprising a stack of n plates.

Such stacks of plates are used, in particular, in thin-type display devices for displaying monochromatic or color pictures in vacuum tubes, plasma displays and plasma-addressed liquid-crystal display devices (PALC displays).

A thin-type display device is disclosed in U. S. Pat. No. 5,313,136 (PHN 12.927). The display device described in said document comprises a vacuum envelope having a transparent front wall whose inner surface is provided with a (luminescent) display screen having a pattern of pixels, and having a rear wall (connected to the front wall by partitions), which extends parallel to said front wall. The known display device comprises at least an electron source and means for guiding electrons to the display screen, which means include a (branched) network of electron-propagation means. Said network of electron-propagation means comprises a stack of plates, which stack includes, between a (pre)selection plate and a further selection plate, a spacer plate provided with coaxial apertures.

In plasma displays, electrons are generated in a number of parallel, elongated ducts, which electrons address directly, or by means of a branched network of electron-propagation means (addressing system), desired (luminescent) pixels of a display screen. The network of electron-propagation means comprises a stack of plates.

In plasma-addressed LCDs (PALC displays), electrodes are formed by a number of parallel, elongated ducts under a plate or layer of an electro-optical material. Each of said (plasma) ducts is filled with an ionizable gas and is sealed by a (thin) dielectric plate which is made, for example, of glass and the inner surface of which is provided with electrodes. In the ducts, a relatively low-energy plasma is generated which causes the (plasma) duct of an (electrically neutral) insulator to change into a conductor. If a suitable voltage is applied to an electrode in a corresponding LC element, then the plasma provides for the conduction necessary to set the voltage across the LC element and hence control the transparency of the element.

OBJECTS AND SUMMARY OF THE INVENTION

It is an object of the invention to provide a simple, rapid and flexible method of positioning and fixing a stack of plates, and to provide a stack of plates which is suitable for said method. The invention further aims at providing a thin-type display device comprising a stack of plates, which can be assembled in a simple manner.

To this end, the inventive method of successively positioning and fixing n plates forming a stack relative to a mounting face having at least a set of n vacuum apertures, which vacuum apertures are connected to a selectively switchable vacuum system, comprises the following steps:

positioning a first plate having at least a set of n−1 apertures against or immediately in front of the mounting face, n−1 of the vacuum apertures in the mounting face corresponding to the n−1 apertures of the first plate, and one vacuum aperture in the mounting face not corresponding to one of the n−1 apertures in the first plate;

retaining the first plate relative to the mounting face by energizing the vacuum system connected to the vacuum aperture in the mounting face which does not correspond to one of the n−1 apertures in the first plate;

positioning a plate i (i=2,3, . . . , n), which is provided with at least a set of n−i apertures, against or immediately in front of plate i−1, n−i of the vacuum apertures in the plate i−1 corresponding to the n−i apertures of the plate i and one aperture in the plate i−1 not corresponding to one of the n−i apertures in the plate i;

retaining the plate i (i=2,3, . . . , n) relative to the plate i−1 by energizing the vacuum system connected to the aperture in the plate i−1 which does not correspond to one of the n−i apertures in the plate i.

fixing the successive plates i (i=2,3, . . . , n) and the first plate relative to each other to form the stack of n plates.

The inventors have recognized that positioning successive plates one by one relative to a mounting face or relative to plates which have already been positioned—a plate being retained (via holes provided in the plates which have already been positioned) after it has been positioned by means of a (selectively switchable) vacuum system until all plates are positioned and retained—followed by the fixation of the stack of successive plates constitutes a rapid and simple method of fixing a stack of plates. To preclude damage to plates, it may be desirable to arrange the first plate of the stack (immediately) in front of the mounting face instead of against said mounting face. This also applies to the positioning of the further plates of the stack relative to plates of the stack which have already been positioned. Positioning the first plate at some distance from the mounting face or positioning plates of the stack at some distance from plates which have already been positioned is all the more desirable if (a part of) the surface of one of the plates is provided with vulnerable structures (for example a system of (small) apertures serving, for example, to form a network of electron-propagation means in a thin-type display device).

In the fixation of a stack of plates, customarily a plate is positioned and then fixed relative to the plates which have already been positioned and fixed relative to each other, said plates being fixed, for example, by means of a fixation agent such as an adhesive, cement or frit and/or an auxiliary element. Since a plate has to be fixed after it has been positioned, a next plate cannot be positioned until the fixation agent has dried, cured or cooled, which considerably slows down the conventional method. In the method in accordance with the invention, this waiting step is precluded, so that this method is rapid and simple. In addition, the absence of this (these) intermediate fixation step(s) allows a flexible method to be obtained because if during the provision and retention of a plate it is found that a plate is positioned incorrectly, the stack of plates can be decoupled in a simple manner and without causing damage. By switching off one or more of the (selectively switchable) vacuum systems, plates of the stack which have already been positioned can be detached, whereafter the plates can be repositioned and retained relative to each other to form the desired stack of plates.

The method in accordance with the invention also yields a more accurate result than that in accordance with the conventional method, because in the latter method every fixation step following the positioning of a plate relative to the plates which have already been positioned and fixed may introduce an inaccuracy in the positioning of the plates relative to each other. This inaccuracy manifests itself, particularly, in a stack of plates if during the fixation of a plate which has already been positioned, the fixation agent is provided, for example, in different thicknesses or if, for example, during curing, drying or cooling of the fixation agent a variation in thickness occurs so that the positioned plate is not fixed in a planar position relative to the preceding plates, but instead, for example, in an oblique position. Such an inaccuracy accumulates if every plate to be positioned has to be fixed relative to the plates already positioned. Plates which are fixed one by one relative to each other generally cannot be decoupled in a simple manner and without damage, so that if one plate in the stack is found to be positioned incorrectly, the plates cannot be unstacked, which leads to unnecessary and undesirable rejection of (intermediate) products.

A further advantage of the method in accordance with the invention is that both during the retention of a plate relative to the plates which have already been positioned (in particular during switching on the vacuum system corresponding to the positioned plate) and during the fixation of the stack of plates, the position of the plates (already provided) relative to each other is not disturbed.

An embodiment of the method in accordance with the invention is characterized in that the method comprises an aligning step for at least one of the plates i (i=1,2,3, . . . , n).

If a plate of the stack has to be very accurately positioned, it is desirable to align said plate relative to the stack. This is achieved in that, after the positioning of successive plates relative to a mounting face or relative to plates which have already been positioned, said plate is aligned relative to one of the plates which have already been positioned (and aligned) or relative to all plates which have already been positioned (and aligned), whereafter the positioned and aligned plate is retained by means of a (selectively switchable) vacuum system (via holes provided for this purpose in the plates already provided) until all plates are positioned, aligned and retained, after which the stack of successive plates is fixed. The successive process steps of positioning, aligning, if necessary, and retaining plates form a rapid and simple method of fixing a stack of plates. By means of this method, intermediate fixation steps are precluded and a flexible method is obtained because if during positioning, aligning, if necessary, and retaining a plate it is found that a plate is incorrectly positioned or aligned relative to a plate which has already been positioned (and aligned), the stack of plates can be decoupled in a simple manner and without causing damage. By switching off one or more of the (selectively switchable) vacuum systems, plates of the stack which have already been positioned (and aligned) can be detached from each other, whereafter the plates can be repositioned, aligned and retained relative to each other to form the desired stack of plates. This is advantageous, in particular, if it is found that in a stack of plates to non-successive plates are incorrectly (positioned or) aligned relative to each other. In addition, if during positioning, aligning or retaining a plate, a previously positioned and aligned plate breaks, unstacking can be carried out in a simple manner and a new plate can be incorporated in the stack. The method in accordance with the invention also leads to a more accurate result than that in accordance with the conventional method since in the latter method an inaccuracy in the positioning of the plates relative to each other can occur during each fixation step after the positioning of a plate relative to the plates already positioned and fixed. In addition, the position of the plates already stacked is not influenced by the alignment of the plate to be positioned.

A further embodiment of the method in accordance with the invention is characterized in that the plates are positioned and fixed in a plane which extends transversely to a horizontal plane.

Since intermediate fixation steps are not necessary, stacking of plates can also be carried out in a simple manner in a plane which makes an angle with the horizontal plane. In the conventional method, in which the plates are placed and fixed one by one, the stack is built up horizontally to preclude that gravity causes the fixation means (for example adhesive, cement or frit) to sag partly between the plates during curing, drying or cooling, as a result of which the position of the plates in the stack relative to each other would no longer be properly defined.

A preferred embodiment of the method in accordance with the invention is characterized in that at least two sets of corresponding vacuum apertures in the mounting face are connected to a selectively switchable vacuum system.

If the plates have relatively large dimensions, it is desirable to provide sets of corresponding apertures in the plates at various locations, which sets correspond to sets of corresponding vacuum apertures in the mounting face. Such sets of apertures are provided, for example, in rectangular plates in the vicinity of two or, preferably three, corners of said plates. In this manner, relatively large plates, which may be aligned or not, can be retained and fixed relative to each other in a simple and efficacious manner.

It is a further object of the invention to provide a stack of plates which can be stacked in a simple, rapid and flexible manner.

To this end, the stack of n plates in accordance with the invention is characterized in that the stack is provided with ducts formed by apertures in the plates, at least a first duct containing an aperture in a first plate and being closed by a second plate, and at least a further duct j (i=2,3, . . . , n−1) comprising corresponding apertures in j plates and being closed by a plate j+1.

A duct is formed by a succession of corresponding apertures in successive plates of the stack of plates. During the manufacture of the stack of plates, the duct serves as a vacuum pipe of the vacuum system and terminates at the plate which is retained by the (separately switchable) vacuum system, said plate forming the closure of the vacuum pipe. In the manufacture of the stack of plates, the plates in said stack are not fixed relative to each other until all plates are positioned, aligned relative to each other, if necessary, and retained by the (separately switchable) vacuum systems. After the stack of plates has been fixed, the vacuum systems are decoupled from the stack.

In this application, the plates of the stack may be completely flat (for example in the case of a stack of (thin) glass plates), but they may alternatively be partly non-flat. Generally, the parts of the plates in which the apertures are provided, which form the ducts (of the vacuum pipe), will be flat in order to cause the flat portions to seat down properly on each other and hence create a satisfactory vacuum effect.

Preferably, the stack of n plates comprises n−1 ducts, so that all successive n plates of the stack can be retained, after positioning and, if necessary, aligning via a selective vacuum system. If the dimensions of the plates are relatively large, it is desirable that the plates should be provided with sets of corresponding ducts at various locations. Such sets of n−1 ducts are provided, for example, in rectangular plates in the vicinity of two, or preferably three, corners of the plates. In this manner, relatively large plates can be retained and fixed relative to each other, whether an aligning step has been carried out or not, in a simple and efficacious manner.

As (mechanical) contact with any tool or other auxiliary agent is unnecessary, the invention can particularly effectively be used to stack plates which are relatively very thin.

In a preferred embodiment of the stack of plates in accordance with the invention, the thickness of said plates is less than 1 mm, preferably in the range between 0.05 and 0.8 mm.

It is a further object of the invention to provide a display device of the type mentioned in the opening paragraph, which comprises a stack of n plates which are stacked in a simple, rapid and flexible manner.

To this end, the thin-type display device of the type mentioned in the opening paragraph is characterized in accordance with the invention in that the stack is provided with ducts formed by apertures in the plates, at least a first duct containing an aperture in a first plate and being closed by a second plate, and at least a further duct comprising j (j=2,3, . . . , n−1) corresponding apertures in j plates and being closed by a plate j+1.

In the manufacture of the stack of n plates, the ducts serve as vacuum pipes of the vacuum system and terminate at the plate which is retained by the vacuum system, said plate forming the closure of the relevant vacuum duct, a duct being formed by a succession of corresponding apertures in successive plates of the stack of plates. In the manufacture of the stack of plates for use in a thin-type display device, the plates in the stack are not fixed relative to each other until all plates have been positioned, aligned relative to each other, if necessary, and retained by the (separately switchable) vacuum systems. After the stack of plates has been fixed, the vacuum systems are decoupled from the stack and said stack forms part of a (branched) network of electron-propagation means. The stack of plates may comprise a so-called (pre)selection plate, a so-called spacer plate and one or more further selection plates, which plates may be provided with (coaxial) apertures and electrodes for (selectively) passing electrons, the network of electron-propagation means forming an addressing system to address desired (luminescent) pixels of a display screen. Preferably, the display device comprises at least 3 and maximally 8 plates.

These and other aspects of the invention will be apparent from and elucidated with reference to the embodiments described hereinafter.

BRIEF DESCRIPTION OF THE DRAWINGS

In the drawings.

The Figures are purely schematic and not drawn to scale. In particular for clarity, some dimensions are exaggerated strongly. Like reference numerals refer to like parts whenever possible.

DESCRIPTION OF THE PREFERRED EMBODIMENTS

Figure 1:
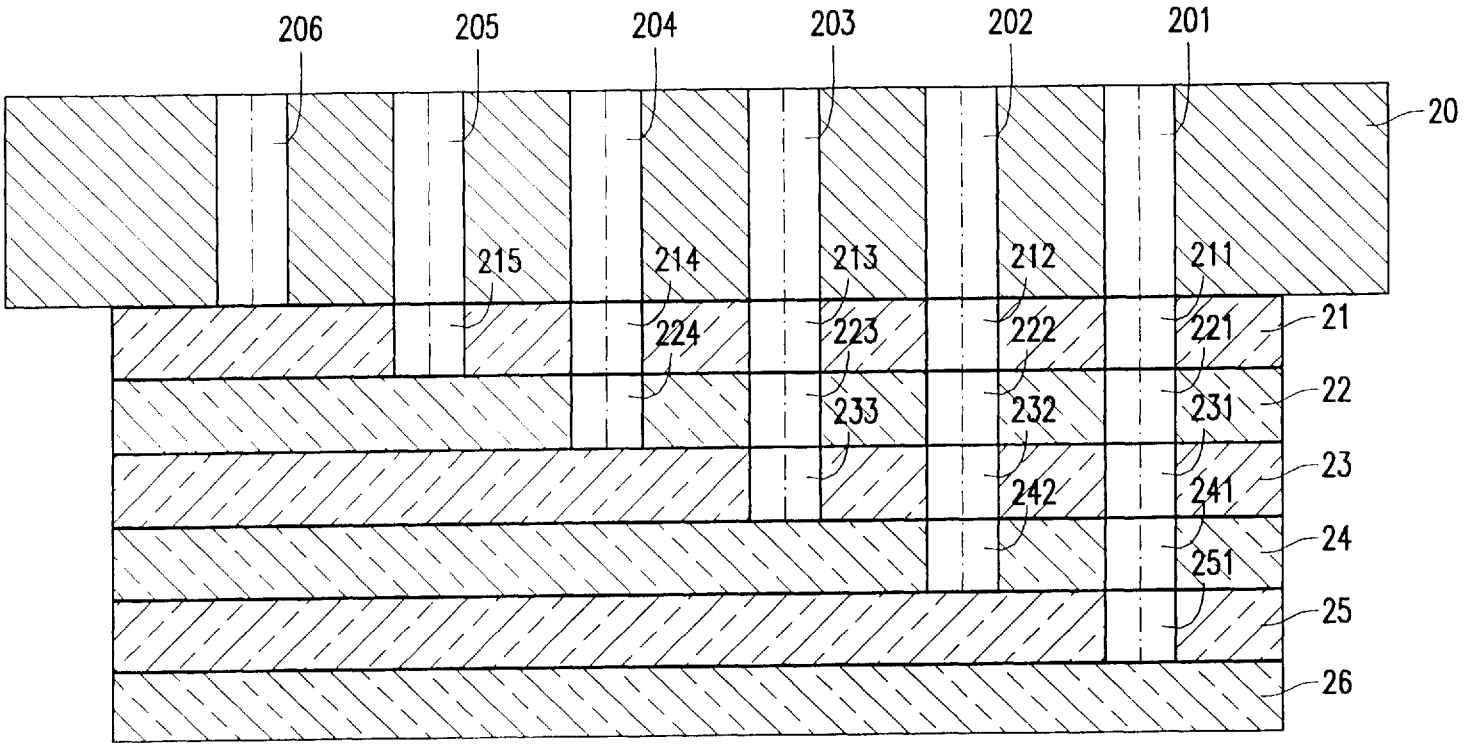
FIG. 1 is a schematic, sectional view of a stack of flat plates in accordance with the invention.
Figure 2:
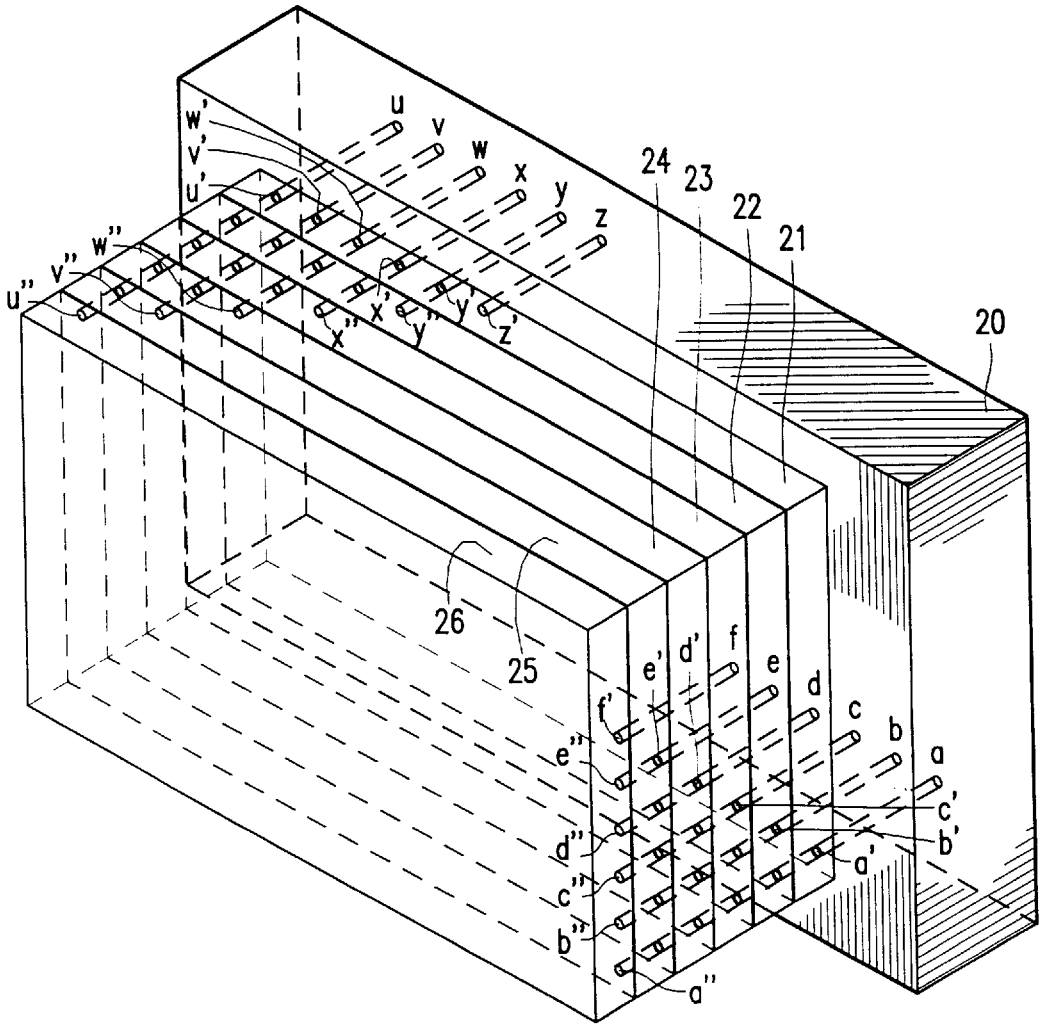
FIG. 2 is a schematic perspective view of a stack of flat plates in accordance with the invention.

FIG. 1 is a schematic, sectional view of a stack of n flat plates having a set of n vacuum apertures in accordance with the invention. FIG. 2 is a schematic, perspective view of an alternative embodiment of a stack of n flat plates having two sets of n vacuum apertures in accordance with the invention. In the examples shown in FIGS. 1 and 2, n=6.

A mounting face 20 is provided with at least a set of n vacuum apertures 201–206, which are connected (on a side of the mounting face 20 facing away from plates 21–26) to a selectively switchable vacuum system (not shown in FIG. 1). The vacuum system may comprise a set of vacuum systems, each vacuum system being connected to one of the n vacuum apertures 201–206, or said vacuum system comprises a single vacuum system which is connected to the vacuum apertures in the mounting face by means of selectively switchable, for example pneumatic, valves. A first plate 21 is provided against or immediately in front of the mounting face 20, said first plate being provided with a set of n−1 apertures 211–215 (in the example of FIG. 1, plate 21 is provided with five apertures), which correspond to n−1 of the vacuum apertures 201–205 in the mounting face 20. Plate 21 is positioned in such a manner that one vacuum aperture 206 in the mounting face 20 does not correspond with one of the n−1 apertures 211–215 in the first plate 21. Subsequently, in the mounting face 20, the vacuum system connected to the vacuum aperture 206 is energized (for example by energizing a switch), so that the first plate 21 is drawn against the mounting face by suction, thereby causing the first plate 21 to be retained relative to the mounting face 20. At the location of the vacuum aperture 206, the surface of the first plate 21 serves as a closure for a vacuum pipe formed by vacuum aperture 206 in the mounting face 20.

After the first plate has been positioned, a second plate 22 is provided against or immediately in front of said first plate 21, which second plate 22 has a set of n−1 apertures 221–224 (in the example of FIG. 1, plate 22 has four apertures), which correspond to n−1 of the apertures 211–214 in the first plate 21. Plate 22 is positioned in such a manner that one aperture 215 in the first plate 21 does not correspond to one of the n−1 apertures 221–224 in the second plate 22. Subsequently, in the mounting face 20, the vacuum system connected to the vacuum aperture 205 is energized, which causes the second plate 22 to be drawn against the first plate 21 by suction via the aperture 215 in said first plate 21, so that the second plate 22 is retained relative to the first plate 21 and the mounting face 20. At the location of the aperture 215, the surface of the second plate 22 serves as a closure for a vacuum pipe formed by the vacuum aperture 205 in the mounting face 20 and aperture 215 in the first plate 21.

For example, if the plates 21–26 of the stack are to be very accurately positioned relative to each other, it is desirable to align the plates 21–26 relative to each other or relative to an external reference. In this case, after the successive plates 21–26 have been positioned one by one relative to a mounting face or relative to one of the plates 22–25 which have already been positioned, each plate 22–26 is aligned relative to one of the plates 21–25 already positioned (and aligned) or relative to all plates 21–25 which have already been positioned (and aligned). To align the plates, one plate or various plates may be provided with one or more (optical) characteristics enabling the aligning process to be carried out within the desired accuracy requirements. After positioning and/or aligning the plates 21–26, it is possible that the apertures in the plates 21–26 are not exactly coaxial as a result of said positioning and/or aligning operation(s). This does not have to be a drawback provided that the apertures correspond to each other in such a way that the desired vacuum pipe can be formed.

In a completely analogous manner, the further successive plates i (i=3,4, . . . , n) 23–26, which are provided with (at least a set of) n–i apertures 231–233; 241–242; 251, are positioned against or immediately in front of plate i–1 22–25, n–i of the apertures 221–223; 231–232; 241 in the plate i–1 22–25 correspond to the n–i apertures 231–233; 241–242; 251 of the plate i 23–26. Plate i 23–26 is so positioned that one aperture 224; 233; 242; 251 in the plate i–1 22–25 does not correspond with one of the n–i apertures in the plate i 23–26. After a possible aligning step, the vacuum system connected to the vacuum aperture 204; 203; 202; 201 is energized in the mounting face 20, which causes the successive plates 23–26 to be drawn against the plate i–1 22–25 by suction via the apertures 214, 224; 213, 223, 233; 212, 222, 232, 242; 211, 221, 231, 241, 251 in the plates 21–25 already positioned, as a result of which the plate i 23–26 is retained relative to the plate i–1 22–25 and the mounting face 20. The surface of the plate i 23–26 serves as a closure for vacuum pipes formed by vacuum apertures 204; 203; 202; 201 in the mounting plane 20 and apertures 214, 224; 213, 223, 233; 212, 222, 232, 242; 211, 221, 231, 241, 251 in the plates i–1 22–25.

The stack of n plates is closed by means of the last plate 26 to be positioned. Apertures serving as a vacuum pipe for retaining a subsequent plate to be provided do not have to be formed in this plate. For this last plate, n–i is equal to zero, so that this plate is indeed without apertures.

The mechanism of retaining the plates by means of vacuum pipes remains operative, even in the case of some leakage, for example, as a result of irregularities in the mounting face or in the plates. The main thing is that the vacuum should be so high that a certain degree of flow is permissible.

The plates of the stack are retained by means of a vacuum in a vacuum pipe, the surface of the plate provided being used to close the vacuum pipe. It is likely that the presence of (micro)dust particles on or between the plates or irregularities in the flatness of the plates may cause a certain degree of "leakage" along the surface of the positioned plate, so that the part of the surface of the positioned plate which is subjected to a vacuum is larger than just a part of the positioned plate which corresponds to the cross-section of the (vacuum) aperture. Such an enlarged part of the surface of the positioned plate which is subjected to the vacuum of the vacuum pipe increases the degree to which the positioned plate is retained relative to the plates which have already been positioned. It may be desirable to stimulate such an effect, for example, by roughening the surface of the positioned plate at the location of the closure for the vacuum pipe.

Every plate 22–26 to be positioned causes the force which is exerted on the plates 21–25 which have already been positioned to increase. If the plates 21–26 are positioned, (aligned) and fixed in a plane transverse to a horizontal plane, the weight of the growing stack of plates hanging on the plates already provided, in particular the first plate 21, increases.

If all plates 21–26 to be positioned are retained by the vacuum system connected to the apertures 201–206 in the mounting face, the successive plates 21–26 can be fixed relative to each other to form the stack of n plates 21–26. Said plates are fixed, for example, by providing a clamping or resilient connection which embraces the stack of plates 21–26, so that the fixation is ensured by friction. In another method of fixation, the plates are fixed relative to each other by using a fixation means such as an adhesive, cement or frit and/or an auxiliary element (for example a fiber or mechanical clamp embracing two or more plates).

After the stack of plates 21–26 has been fixed, the vacuum in the vacuum system can be removed and the stack of plates 21–26 can be detached from the mounting face 20, and the stack thus formed can be incorporated, for example, in a display device.

If the plates have relatively large dimensions, it is desirable that sets of n corresponding apertures should be provided at various locations in the plates 21–26, which sets correspond to sets of n corresponding vacuum apertures in the mounting face. In the example of FIG. 2, two such sets of six apertures each are provided in the vicinity of two corners of six plates, a first set of apertures forming six ducts a–a'–a", b–b'–b", c–c'–c", d–d'–d", e–e'–e" and f–f', and a second set of apertures forming six ducts u–u'–u", v–v'–v", w–w'–w", x–x'–x", y–y'–y", z–z'.

Figure 3:
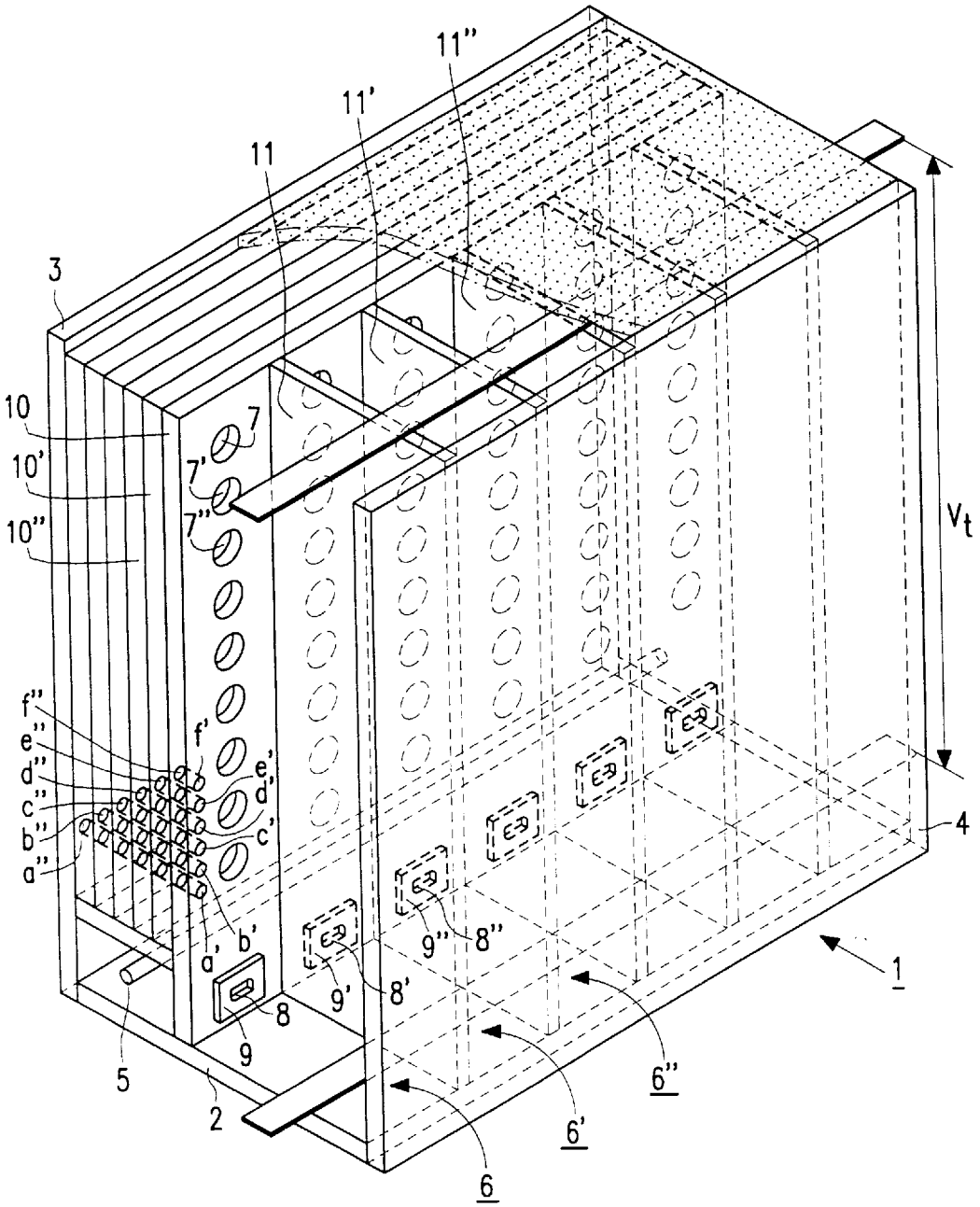
FIG. 3 is a schematic, perspective view, partly cut away, of a part of a construction of a thin-type display device.

FIG. 3 is a very schematic, perspective view, partly cut away, of an example of a construction of a thin-type display device 1 comprising a stack of plates in accordance with the invention. The invention is important, in particular, for this type of thin display devices. The display device comprises a front wall (window) 3 and an oppositely located rear wall 4, which extends parallel to said front wall. On the inner surface of the front wall 3, there is provided a display screen comprising a (regular) pattern of pixels luminescing, respectively, in red, green and blue. Near an upright side wall 2, which interconnects the front wall 3 and the rear wall 4, there is positioned at least an electron source 5. This electron source 5 includes, for example, a cathode arrangement which contains one or more line cathodes or a large number of separate electrodes. A number of electron-propagation means, which cooperate with the electron source 5 are arranged next to said electron source, which electron-propagation means are formed by ducts 6, 6', 6" etc., which are separated from the electron-propagation means by walls 11, 11', 11" etc., which extend at right angles to the rear wall 4 so as to form the ducts of a so-called duct structure. The electron-propagation means cooperate via a cathode plate having (entrance) apertures 8, 8', 8" and electrodes 9, 9', 9" etc., with the electron source 5 and extend substantially parallel to the front wall. In the example of FIG. 3, the apertures 8, 8', 8" are rectangular. In alternative embodiments, the apertures 8, 8', 8" are square, round, oval or of any other shape. In a further alternative embodiment of the display device 1, the electron source 5 is arranged in the extension of the duct structure. A plate 10, which closes the ducts 6, 6', 6" etc., is provided with holes 7, 7', 7" etc., to guide the electrons to the display screen. In this example, plate 10 comprises a stack of a number of plates 10, 10', 10" etc., which stack includes an addressing system comprising a (branched) network of electron-propagation means for addressing desired pixels. The addressing system in the stack of plates 10, 10', 10" etc., the holes in the plates being very accurately aligned, imposes high requirements on the alignment of the plates 10, 10', 10" etc., relative to each other during the manufacture of the stack. To this end, the stack of plates 10, 10', 10" etc., in the thin-type display device as shown in FIG. 3 is provided, near an edge of the display device, with ducts a'–a", b'–b", c'–c", d'–d", e'–e", and f'–f", which are used, during the manufacture of the stack, to retain the stack of plates 10, 10', 10" etc., after the plates 10, 10', 10" etc., have been positioned and accurately aligned relative to each other.

Figure 4:
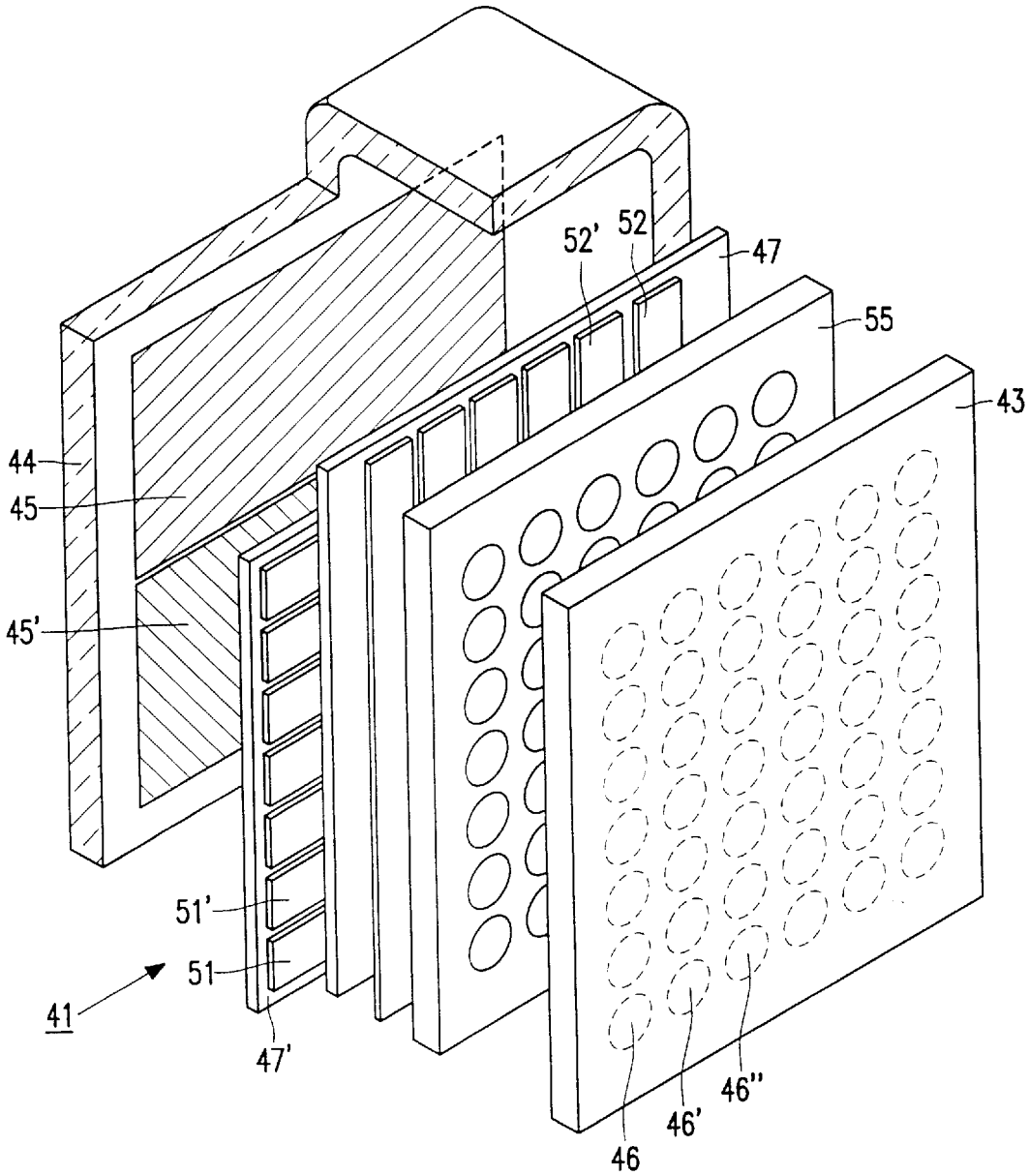
FIG. 4 is a schematic, perspective view, partly cut away, of a part of an alternative construction of a thin-type display device (plasma display panel).

FIG. 4 is a very schematic, perspective view, partly cut away, of a part of an alternative construction of a thin-type display device. The display device in question is commonly referred to as a plasma display panel (pdp). The plasma display panel (41) comprises a network of electron-propagation means, the so-called selection structure 47; 47' provided with apertures (not shown in FIG. 4) and with row electrodes 51, 51' and column electrodes 52, 52', which electron-propagation means are arranged in a vacuum envelope between a rear wall 44 provided with one or more plasma cathodes 45, 45' and a front wall 43 provided with a display screen with a pattern of luminescent pixels 46, 46', 46" etc. In this example, the network of electron-propagation means comprises a stack of two plates 47, 47'. In operation, a gas-discharge is maintained between the plasma cathode 45, 45' and a (series of) row electrode(s) 51, 51', which serve as the anode. A number of electrons from the gas-discharge reach the anode and pass through the holes in the plates of the selection structure 47, 47' at the location where a row electrode and a column electrode cross each other. The current through the selection structure 47; 47' is determined by the voltage applied across the column electrode 52, 52' corresponding to the relevant row electrode. As soon as the electrons have passed through the selection structure 47; 47', they are accelerated by an accelerating field which in this example is formed in a so-called flu-spacer 55 in order to provide the electrons with sufficient energy to excite the luminescent pixels 46, 46', 46" etc. A flu-space is an apertured plate extending between the luminescent pixels 46, 46', 46" etc. and the exits of the selection structure 47; 47'.

The method described hereinabove enables a stack of a number of relatively thin plates (having a thickness ranging, for example, between 0.3 and 1 mm) of very large dimensions (having a surface area, for example, of 620 ×1015 mm) to be assembled with a high degree of accuracy relative to each other (the deviation in the position of the plates relative to each other being less than, for example, 20 $\mu$m).

It will be obvious that within the scope of the invention many variations are possible to those skilled in the art. For example, the apertures in the plates, which form the vacuum pipes, do not have to be round or rectangular but may alternatively have other cylindrical shapes. In addition, the apertures in the plates may be different in section, which may further simplify the positioning and alignment of the plates. For example, apertures which narrow and/or widen gradually relative to each other (in steps or frustoconically) would be conceivable. The apertures in one or more plates may also comprise the (optical) characteristics which serve to align the plates of the stack, thus enabling the plates to be aligned with-in the desired accuracy requirements. It is also possible to use a non-selectively switchable vacuum system in which a vacuum is created continuously via all vacuum apertures in the mounting face, which further simplifies the manufacture of the stack of plates.

In general, the invention relates to a method of successively positioning and fixing a stack of n plates relative to a mounting face, which method includes the positioning and aligning, if necessary, of n plates, each plate being retained, after it has been positioned relative to the mounting face or relative to plates which have already been positioned, by means of a vacuum in a vacuum pipe in the plates already positioned. When all plates are positioned and retained by a vacuum system connected to vacuum apertures in the mounting face, successive plates can be fixed relative to each other so as to form the stack of n plates. The vacuum pipes form ducts in the plates, at least one duct comprising i (i=1,2,3, . . . , n−1) corresponding apertures in i plates and being closed by a plate i+1. Such stacks are used in thin-type display devices.

I claim:

1. A method of forming an electron-propogation means comprising successively positioning and fixing n plates forming a stack (21–26) relative to a mounting face (20) having at least a set of n vacuum apertures (201–206), which vacuum apertures are connected to a selectively switchable vacuum system, comprising the following steps:

a) positioning a first plate (21) having at least a set of n−1 apertures (211–215) against or immediately in front of the mounting face (20), n−1 of the vacuum apertures (201–205) in the mounting face (20) corresponding to the n−1 apertures (211–215) of the first plate (21), and one vacuum aperture (206) in the mounting face (20) not corresponding to one of the n−1 apertures in the first plate (21);

b) retaining the first plate (21) in position relative to the mounting face (20) by energizing the vacuum system connected to the vacuum aperture (206) in the mounting face (20) which does not correspond to one of the n−1 apertures in the first plate (21);

c) positioning a plate i (i=2,3, . . . , n) (22–26), which is provided with at least a set of n−i apertures (221–224; 231–233; 241–242; 251), against or immediately in front of plate i−1 (21–25), n−i of the vacuum apertures (211–214; 221–223; 231–232; 241) in the plate i−1 (21–25) corresponding to the n−i apertures (221–224; 231–233; 241–242; 251) of the plate i (22–26) and one aperture (215; 224; 233; 242; 251) in the plate i−1 (21–25) not corresponding to one of the n−i apertures in the plate i (22–26);

d) retaining the plate i (i=2,3, . . . , n) (22–26) relative to the plate i−1 (21–25) by energizing the vacuum system connected to the aperture (215; 224; 233; 242; 251) in the plate i−1 which does not correspond to one of the n−i apertures in the plate i (22–26), and e) fixing the successive plates i (i=2,3, . . . , n) (22–26) and the first plate (21) relative to each other to form the stack of n plates (21–26).

2. A method as claimed in claim 1, characterized in that the method comprises an aligning step for at least one of the plates i (i=1,2,3, . . . , n) (21–26).

3. A method as claimed in claim 1, characterized in that the plates (21–26) are positioned and fixed in a plane which extends transversely to a horizontal plane.

4. A method as claimed in claim 1, characterized in that at least two sets of corresponding vacuum apertures in the mounting face (20) are connected to a selectively switchable vacuum system.

5. An electron-propagation means comprising a stack of n plates (21–26), characterized in that the stack is provided with ducts formed by apertures in the plates (21–26), at least a first duct containing an aperture (215) in a first plate (21) and being closed by a second plate (22), and at least a further duct j (j=2,3, . . . , n−1) comprising corresponding apertures (214, 224; 213, 223, 233; 212, 222, 232, 242; 211, 221, 231, 241, 251) in j plates (22–25) and being closed by a plate j+1 (23–26).

6. A stack of n plates (21–26) as claimed in claim 5, characterized in that the stack comprises n−1 ducts.

7. A thin-type display device which thin-type display device (1;41) comprises a transparent front wall (3;43) , which is provided with a display screen having a pattern of pixels (46, 46', 46") ; a rear wall (44 44) , which extends parallel to said front wall (33, 43) , at least an electron source (5, 45, 45') and means for guiding electrons to the display screen, which means include a network of electron-propagation means, said network comprising the stack of claim 6.

8. A stack of n plates (21–26) as claimed in claim 5 or 6, characterized in that the stack comprises at least two sets of n−1 ducts.

9. A thin-type display device as claimed in claim 7, wherein the thin-type display device (1;41) comprises a transparent front wall (3; 43), which is provided with a display screen having a pattern of pixels (46, 46', 46"), a rear wall (4; 44), which extends parallel to said front wall (3;43), at least an electron source (5, 45, 45') and means for guiding electrons to the display screen, which means include a network of electron-propagation means, said network comprising the stack of claim 8.

10. A stack of n plates (21–26) as claimed in claim 5, characterized in that the thickness of the plates (21–26) is less than 1 mm, preferably in the range between 0.05 and 0.8 mm.

11. A thin-type display device as claimed in claim 8, wherein the thin-type display device (1;41) comprises a transparent front wall (3; 43), which is provided with a display screen having a pattern of pixels (46, 46', 46"), a rear wall (4 44), which extends parallel to said front wall (3;43), at least an electron source (5; 45; 45') and means for guiding electrons to the display screen, which means include a network of electron-propagation means, said network comprising the stack of claim 10.

12. A thin-type display device in which thin-type display device (1;41) comprises:

a transparent front wall (3, 41), which is provided with a display screen having a pattern of pixels (46, 46', 46"), a rear wall ( 4 , 44), which extends parallel to said front wall (3,), at least an electron source (5, 45, 45') and means for guiding electrons to the display screen, which means include a network of electron-propagation means, said network comprising the stack of claim 5.

* * * * *